US008420224B2

(12) United States Patent
Takahashi et al.

(10) Patent No.: US 8,420,224 B2
(45) Date of Patent: Apr. 16, 2013

(54) ZINC-BASED PLATED STEEL SHEET EXCELLENT IN SURFACE ELECTRICAL CONDUCTIVITY HAVING PRIMARY RUST PREVENTIVE THIN FILM LAYER

(75) Inventors: Akira Takahashi, Tokyo (JP); Atsushi Morishita, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 37 days.

(21) Appl. No.: 12/735,628

(22) PCT Filed: Feb. 15, 2008

(86) PCT No.: PCT/JP2008/053108

§ 371 (c)(1), (2), (4) Date: Oct. 7, 2010

(87) PCT Pub. No.: WO2009/101707

PCT Pub. Date: Aug. 20, 2009

(65) Prior Publication Data

US 2011/0027611 A1 Feb. 3, 2011

(51) Int. Cl.
*B32B 3/00* (2006.01)

(52) U.S. Cl.
USPC ..... 428/612; 428/659; 428/621; 428/687

(58) Field of Classification Search ..... None
See application file for complete search history.

(56) References Cited

U.S. PATENT DOCUMENTS

2005/0244660 A1 11/2005 Yuasa et al.

FOREIGN PATENT DOCUMENTS

| | | |
|---|---|---|
| CN | 1613986 | 5/2005 |
| CN | 1668460 | 9/2005 |
| JP | 2000-319787 | 11/2000 |
| JP | 2002080979 | * 3/2002 |
| JP | 2002-363766 | 12/2002 |
| JP | 2002-363768 | 12/2002 |
| JP | 2004-277876 | 10/2004 |
| JP | 2005-089780 | 4/2005 |
| JP | 2005-238535 | 9/2005 |
| JP | 2006-278653 | 10/2006 |
| JP | 2007-331218 | 12/2007 |
| TW | 200806468 | 2/2008 |

OTHER PUBLICATIONS

International Search Report dated Apr. 1, 2008 issued in corresponding PCT Application No. PCT/JP2008/053108.

(Continued)

*Primary Examiner* — Jennifer McNeil
*Assistant Examiner* — Daniel J Schleis
(74) *Attorney, Agent, or Firm* — Kenyon & Kenyon LLP

(57) ABSTRACT

A zinc or zinc alloy plated steel sheet expressing a performance provided with both corrosion resistance and surface conductivity is provided. The zinc or zinc alloy plated steel sheet of the present invention is a zinc or zinc alloy plated steel sheet having an arithmetic average roughness Ra of a zinc-plated layer surface defined by JIS B 0601, obtained by a stylus-type surface roughness meter defined by JIS B 0651, of 0.3 μm to 2.0 μm and a maximum peak height Rp of 4.0 μm to 20.0 μm, wherein the arithmetic average roughness Ra (peak) obtained by measuring a range of evaluation length of 20 μm of peak parts of 80% or more of the Rp by an electron beam 3D roughness analyzer is 70% or more of the arithmetic average roughness Ra (average) obtained by measuring a range of evaluation length of 20 μm of parts of a height of ±20% about an average line, obtained by a stylus-type surface roughness meter, by an electron beam 3D roughness analyzer.

3 Claims, 3 Drawing Sheets

OTHER PUBLICATIONS

"Geometrical Product Specification (GPS)—Surface texture: Profile method—Terms, definitions and surface texture parameters," JIS B 0601: 2001 (ISO 4287: 1997), pp. 268-274.

Zhu et al., "Effects of High-Speed Zinc Plating on Coating Roughness and Texture," Electroplating & Pollution Control, vol. 24, No. 4, Jul. 2004, pp. 14-16.

* cited by examiner

ZINC-BASED PLATED STEEL SHEET EXCELLENT IN SURFACE ELECTRICAL CONDUCTIVITY HAVING PRIMARY RUST PREVENTIVE THIN FILM LAYER

This application is a national stage application of International Application No. PCT/JP2008/053108, filed 15 Feb. 2008, which is incorporated by reference in its entirety.

TECHNICAL FIELD

The present invention relates to a zinc-based surface-treated steel sheet used for PCs, audio, TV, and other home appliances and copiers, printers, facsimiles, and other office automation products which is superior in the conductivity of the steel sheet surface, which becomes essential for securing the groundability and electromagnetic shielding performance of steel sheet members after assembly of the home electronics or office automation products, and is also provided with corrosion resistance.

BACKGROUND ART

For a long time, surface-treated steel sheet comprised of galvanized steel sheet treated on its surface by chromate has been used in large quantities for industrial products in a broad range of fields. This galvanized steel sheet had a high ability to suppress the formation of white rust which occurred when used under the usual atmospheric environment and further had the features of easily securing conductivity between the electronic board and steel member and having superior groundability and shielding performance. The ability to suppress white rust was high-due to, it was believed, the high ability of passivation of a chromate film to plated zinc material and the high ability of the film of self repair of damages. Further, the conductivity was good since the chromate treated layer was thin and uniform, so the contact resistance with the conductive terminals was kept low.

In recent years, the demands on materials for reduction of environmental load substances and toxic substances have grown tougher. There is an increasing movement toward restricting use of the hexavalent chrome used for chromate films. Hexavalent chrome is a toxic substance identified as being carcinogenic. Restrictions on discharge of hexavalent chrome in the process of production of surface-treated steel sheet and harm to health accompanying elution thereof at the time of use of the steel sheet are concerns.

Therefore, the inventors developed a treated film not using chromate at all (for example, see JP 2000-319787 A). JP 2000-319787 A disclosed the technology of coating the surface of a galvanized steel sheet with a rust preventive coating layer. To improve the corrosion resistance, phosphoric acid or an inhibitor ingredient was suitably added. This treated steel sheet was superior in corrosion resistance due to being coated with an insulating resin layer, but had the defect of being inferior in surface conductivity. Therefore, the rust preventive steel sheet of JP 2000-319787 A cannot at present be said to have sufficient characteristics for application to home electronics, office automation products, and other equipment stressing groundability.

Here, "groundability" means making the potential of the surface of the steel sheet caused by electromagnetic waves emitted from electronic components or electromagnetic waves coming from outside the device the same as the ground potential. If this groundability is insufficient, trouble such as erroneous operation or breakdown of the electronic equipment, noise, etc. will occur.

Electronic equipment up to now have generally secured this groundability by being screwed to steel housings, chassis, etc. In this case, the end faces of the steel sheet were exposed at the screw holes, so metal-metal conduction could be easily obtained regardless of any chromate layer. However, along with the increasingly smaller size and higher performance of electronic equipment in recent years, the number of complicatedly shaped parts has increased, the screw-fastened parts have decreased, and parts have increasingly been joined by contact of steel sheet surfaces, or contact by caulking or leaf springs. In this case, it is important that the surface of the plated steel sheet be small in contact resistance. In systems coated with insulating resin explained above, the groundability therefore became insufficient.

As prior art for improving this groundability, JP 2004-277876 A forms an intermediate layer having groundability at the surface of the plating layer and further forms an organic resin layer on the surface thereof and specifies that the coverage rate of the organic resin layer is at least 80% and for the surface roughness of the steel sheet, an arithmetic average roughness Ra is 1.0 to 2.0 μm and a filtered center line waviness Wca is not more than 0.8 μm.

Further, JP 2005-238535 A discloses the art of obtaining a surface roughness of a sheet stock to be plated by defining the surface roughness Ra and PPI of electrodischarge treated temper rolling rolls and securing conductivity of the resultant obtained galvanized steel sheet without impairing the corrosion resistance.

Furthermore, JP 2002-363766 A defines the surface roughness of the sheet stock itself to be plated by the count of peaks and the Ra so as to achieve both corrosion resistance and conductivity.

However, while JP 2004-277876 A, JP 2005-238535 A, and JP 2002-363766 A all demonstrate an effect of improvement of the conductivity, the performance is not stably expressed and depending on the production line, conductivity cannot be secured. Development of technology stably securing conductivity has been desired.

Galvanized steel sheet coated with a chromate-free film is produced by subjecting a coil-shaped steel sheet continuously to a plating treatment and chromate-free treatment. The plating method includes electroplating and hot dip plating. The former is the art of electrochemically causing the precipitation of zinc in an aqueous solution containing Zn ions, while the latter is the art of immersing a steel sheet in a molten state metal zinc bath to form a film. The surface configuration of the plating is, in the case of electroplating, high in uniformity of formation of the plating, so the surface configuration of the sheet stock is maintained, but with hot dip plating, the leveling property is high and configuration is generally imparted by transfer of the configuration of the temper rolling roll after plating. The plated steel sheet is coated with a resin-based or inorganic chromate-free film or chromate film, baked, and dried by a later post-treatment section. After this, it is coiled to obtain the final product.

DISCLOSURE OF THE INVENTION

A zinc or zinc alloy plated steel sheet produced by such a production process contacts a large number of metal rolls in the process of production. Depending on the rolls, the steel sheet surface is often subjected to a relatively high rolling force. If the plated surface is rolled by metal rolls after galvanization and before coating in a post-treatment section, there is a good chance of the configuration of the plated surface changing. The galvanization metal has a microvicker's hardness of about 50 or so, that is, is soft, so the projecting portions of the plating are often crushed flat by the metal rolls. Such deformation occurs in the microscopic region, so it is often not possible to sufficiently recognize changes in configuration by measurement by the stylus-type surface roughness meter defined in JIS B 0651. Further, with such crushed configurations, the roughness of the sheet stock or the roughness imparted by the temper rolling of the sheet stock after plating ends up changing and the state of surface coverage of a thin-film primary rust preventive coating layer also changes so sufficient conductivity can no longer be expressed.

That is, the issue has been to avoid the drop in conductivity due to crushing of the projecting parts of a plated surface caused in the current process of production using a continuous plating facility for galvanization and post treatment.

The inventors engaged in in-depth studies to achieve both conductivity and corrosion resistance of a zinc or zinc alloy plated steel sheet treated without chromate. As a result, they discovered that it becomes possible to achieve both conductivity and corrosion resistance not by managing the roughness of a zinc or zinc alloy plated layer surface by measuring the roughness parameter defined in JIS B 0601 using the device defined in JIS B 0651, but by defining the microscopic region roughness of plating projecting parts. Further, they discovered that the ratio of portions with a roughness of projecting parts equal to or higher than a certain value being at least a certain value is also important. The present invention was made based on the above discovery.

That is, the gist of the present invention is as follows:

(1) A zinc or zinc alloy plated steel sheet superior in surface conductivity after being given a thin-film primary rust preventive coating layer having an arithmetic average roughness Ra of a zinc-plated layer surface defined by JIS B 0601, obtained by a stylus-type surface roughness meter defined by JIS B 0651, of 0.3 μm to 2.0 μm and a maximum peak height Rp of 4.0 μm to 20.0 μm, wherein the arithmetic average roughness Ra (peak) obtained by measuring a range of evaluation length of 20 μm of peak parts of 80% or more of the Rp by an electron beam 3D roughness analyzer is 70% or more of the arithmetic average roughness Ra (average) obtained by measuring a range of evaluation length of 20 μm of parts of a height of ±20% about an average line, obtained by a stylus-type surface roughness meter, by an electron beam 3D roughness analyzer.

(2) A zinc or zinc alloy plated steel sheet superior in surface conductivity after being given a thin-film primary rust preventive coating layer as set forth in (1), wherein the area of the parts where the arithmetic average roughness Ra (peak) obtained by measuring a range of evaluation length of 20 μm of peak parts of 80% or more of the Rp defined by JIS B 0601, obtained by a stylus-type surface roughness meter, by an electron beam 3D roughness analyzer is less than 70% of the arithmetic average roughness Ra (average) obtained by measuring a range of evaluation length of 20 μm of parts of a height of ±20% about an average line, obtained by a stylus-type surface roughness meter, by an electron beam 3D roughness analyzer is 5% or less of the zinc-plated surface area as a whole.

(3) A zinc or zinc alloy plated steel sheet superior in surface conductivity after being given a thin-film primary rust preventive coating layer as set forth in (1) or (2), wherein the arithmetic average roughness Ra (peak) obtained by measuring a range of evaluation length of 20 μm of peak parts of 80% or more of the Rp defined by JIS B 0601, obtained by a stylus-type surface roughness meter, by an electron beam 3D roughness analyzer is 0.03 μm to 1.0 μm.

(4) A zinc or zinc alloy plated steel sheet superior in surface conductivity after being given a thin-film primary rust preventive coating layer as set forth in any one of (1) to (3), wherein an average thickness of the thin-film primary rust preventive coating layer is 0.2 μm to 5.0 μm.

(5) A method of production of a zinc or zinc alloy plated steel sheet superior in surface conductivity after being given a thin-film primary rust preventive coating layer, said zinc or zinc alloy plated steel sheet produced by plating a steel sheet with zinc or a zinc alloy, and then forming a thin-film primary rust preventive coating layer, said zinc or zinc alloy plated steel sheet having an arithmetic average roughness Ra of a surface of a zinc-plated layer defined by JIS B 0601, obtained by a stylus-type surface roughness meter defined by JIS B 0651, of 0.3 μm to 2.0 μm and a maximum peak height Rp of 4.0 μm to 20.0 μm, an arithmetic average roughness (Ra) (peak) obtained by measuring a range of an evaluation length of 20 μm of peak parts with 80% or more of the Rp by an electron beam 3D roughness analyzer being 70% or more of an arithmetic average roughness Ra (average) obtained by measuring a range of evaluation length of 20 μm of parts of a height of ±20% about an average line, obtained by a stylus-type surface roughness meter, by an electron beam 3D roughness analyzer, said method characterized by controlling a rolling force so that a relation stands where a rolling force F ($N/mm^2$) per mm roll length applied to a plating surface by pinch rolls contacting a conveyed steel sheet and a microvicker's hardness MHv of the plating layer measured by JIS Z 2244 satisfy the following relation (1) from when the steel sheet is provided with the zinc-plated layer to the formation of the thin-film primary rust preventive coating layer:

$$F<9.8065\mathrm{MHv}\times(R^2-(R-h\times10^{-3})^2)^{0.5} \quad (1)$$

where, R is a roll radius (mm), and h is a value of Rp of the plated steel sheet (μm).

According to the present invention, even if making the thickness of the thin-film primary rust prevention coating layer thicker, conductivity is expressed, so this is achieved along with corrosion resistance. Further, if it is possible to make the layer thicker, not only the corrosion resistance, but also the press workability, the ability to impart flaw resistance, the ablation resistance, and other features are also improved. Further, if controlling production using the plating roughness of the present invention as an indicator, it becomes possible to produce zinc or zinc alloy plated steel sheet stably balanced in conductivity and corrosion resistance even in production on various plating lines.

BEST MODE FOR CARRYING OUT THE INVENTION

Below, details of the present invention will be explained.

Figure 1:
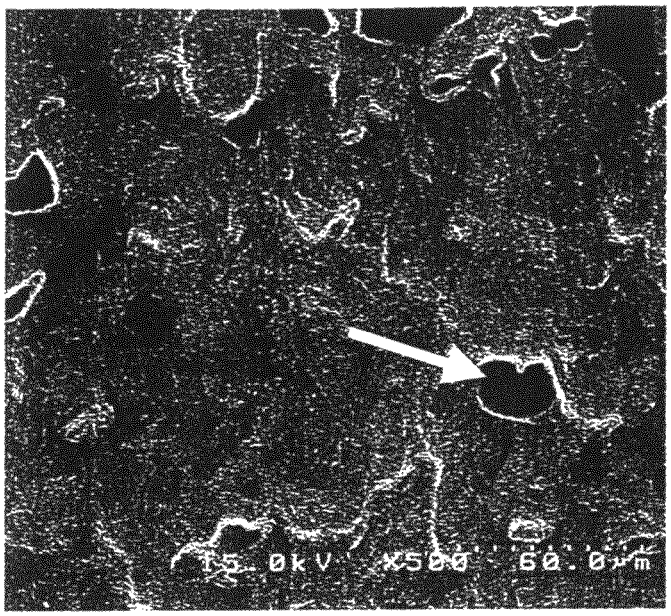
FIG. 1 is a scanning electron micrograph of the surface of an electrogalvanized steel sheet.

The inventors examined in detail the configurations of plated surfaces of zinc or zinc alloy plated steel sheets produced by continuous plating facilities. An example of a scanning electron micrograph of the surface of an electrogalvanized steel sheet produced on an electrogalvanization line is shown in FIG. 1. The inventors discovered that a plating layer is formed along the relief configuration of the sheet stock imparted by temper rolling and that the plating layer surface has micro configuration caused by the microcrystal forms of the electrogalvanization layer itself. However, they discovered that the configuration caused by the microcrystal forms on the surface of the plating layer formed on sheet stock projecting parts includes flattened portions due to crushing. The portion is shown by the dark contrast indicated by the arrow in the figure. The roughness of this crushed portion cannot be measured by a stylus-type surface roughness meter defined by JIS B 0651. That is, a stylus-type surface roughness meter uses a metal stylus as a measurement probe, and the radius of curvature R of the front end of the stylus is about 5 μm, so it is not possible to detect the microcrystal forms caused by plating crystals of FIG. 1. Therefore, the inventors studied intensively the technique for measuring such microcrystal forms and as a result learned that it is sufficient to use a scanning electron microscope type 3D roughness analysis system.

Figure 2A:
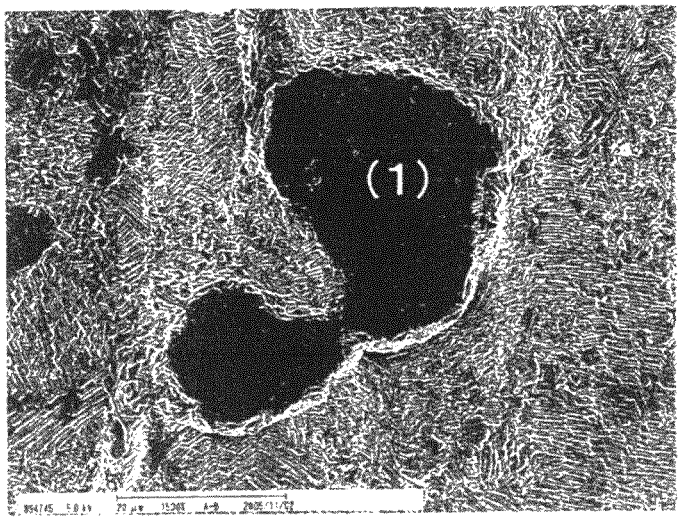
FIG. 2A is a composite image of combined signals of 4-channels by an electron beam 3D roughness analyzer.
Figure 2B:
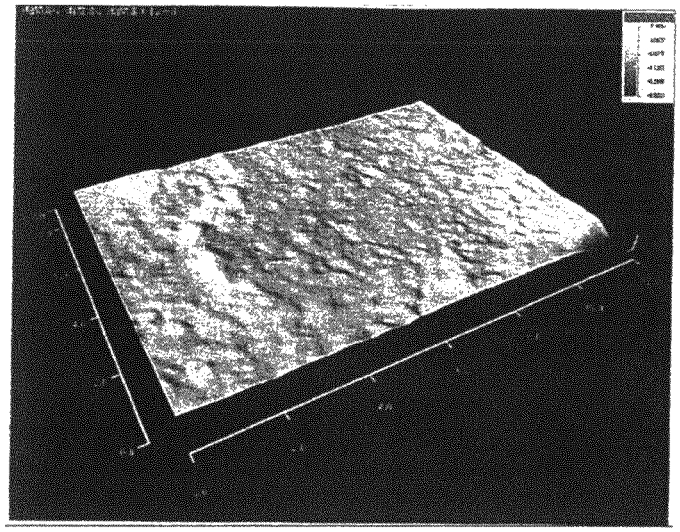
FIG. 2B is a 3D analyzed image of the part (1) of FIG. 2A.
Figure 2C:
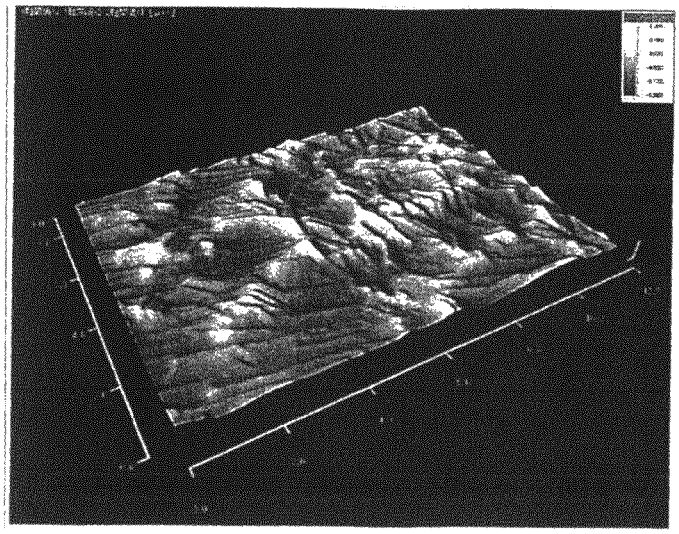
FIG. 2C is a 3D analyzed image of the surroundings of the part (1) of FIG. 2A.

FIG. 2A to FIG. 2C show the results of measurement using a field emission electron beam 3D roughness analyzer (ERA-8900FE) made by Elionix. This analyzer is equipped with a 4-channel secondary electron beam detector and can quantify surface relief. As a result, the resolution of the roughness analysis is extremely high, and is 1 nm in the height direction and 1.2 nm in the plane direction. It is possible to sufficiently measure micro forms of the plating crystals of FIG. 1.

The photograph of FIG. 2A is a composite image of the combined signals of the 4-channels. The dark contrast part in the figure (area of (1) in the figure) is the region of the projection of the sheet stock. The plating layer is crushed and flattened there. On the other hand, the area of the surrounding parts represents the depressed part of the sheet stock, where the microcrystal forms of the plating layer are maintained. The micro configurations of these areas are respectively shown in FIG. 2B and FIG. 2C.

Furthermore, to quantify the surface configuration at the local regions based on this digital image data, the value of Ra in the region of the evaluated length 20 μm was found. The Ra of the crushed area of (1) in FIG. 2A was 0.02 μm, while the Ra of the other parts was 0.06 μm. That is, by measuring the roughness in the extremely narrow range of an evaluation length of 20 μm, the projecting crushed parts and the other parts where the plating microcrystals remain differ in Ra by close to 3-to-1 ratio, whereby it was possible to clearly indicate the difference in roughness.

Figure 3A:
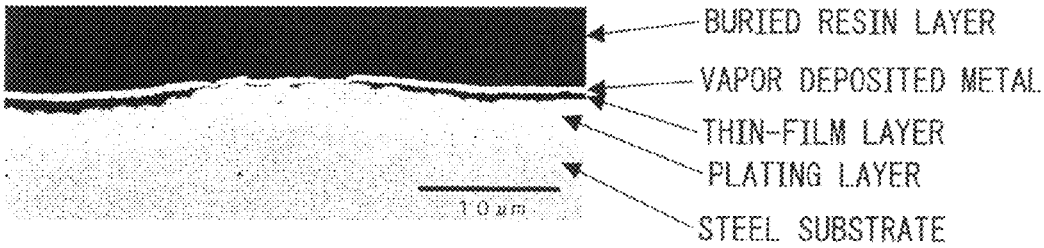
FIG. 3A is a scanning electron micrograph of a cross-section of an electrogalvanized steel sheet covered with a thin-film primary rust-preventive layer without plating microcrystals of the sheet stock projecting parts being crushed.
Figure 3B:
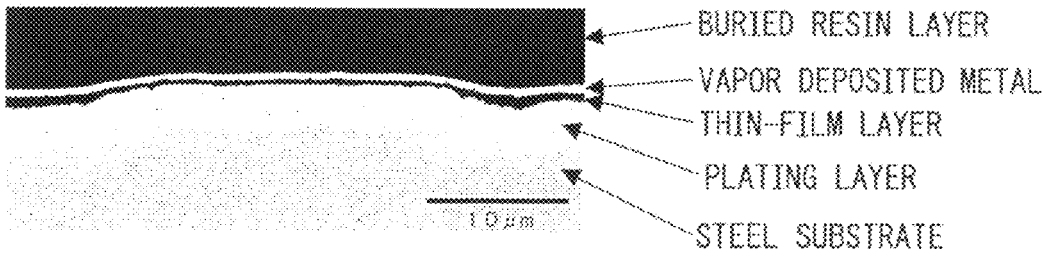
FIG. 3B is a scanning electron micrograph of a cross-section of an electrogalvanized steel sheet covered with a thin-film primary rust-preventive layer with plating microcrystals of the sheet stock projecting parts crushed.

Next, the inventors studied in detail the effects of such micro configuration of the sheet stock projecting parts on the state of coverage of the surface of a thin-film primary rust prevention coating film. The inventors coated a plated steel sheet without the plating microcrystals of the sheet stock projecting parts being crushed and a steel sheet with them crushed with water-based polyolefin resin coatings to 1.2 μm and examined their cross-sectional structures by a scanning electron microscope. The results are shown in FIG. 3A and FIG. 3B. The resin-coated layer of the not crushed plated steel sheet of FIG. 3A becomes thin at the projecting parts of the sheet stock. Further, at the projecting parts of the microcrystals at the plating layer surface of those parts, a state where the resin-coating layer did not completely cover the surface was observed. On the other hand, the inventors learned that at the crushed plating of the sheet stock projecting parts of FIG. 3B, the resin-coating layer became thin, but completely covered the surface. That is, if there are microcrystal forms of the plating layer surface of sheet stock projecting parts, these act to lower the coverage of the resin layer and partially expose the plating layer. These exposed parts become conduction points, so the inventors learned that conductivity was secured by contact of steel sheets with each other or contact with a conductive terminal. On the other hand, the inventors learned that parts where the micro configuration of the plating layer at sheet stock projecting parts are crushed are covered by the insulating resin film, so no conductivity was expressed. That is, the inventors discovered that to improve the conductivity of electrogalvanized steel sheet, just controlling the relief configuration of the sheet stock is not enough and that leaving a microcrystalline structure at the plating layer surface of the projecting parts is important.

The present invention was made based on these technical discoveries. The inventors used as an indicator defining the residual degree of micro configuration at the plating layer surface of sheet stock projecting parts the value of Ra of an evaluation length 20 μm of the parts other than the projecting part and judged that if the value of Ra of the sheet stock projecting parts is 70% or more, crushing does not occur or there is some crushing, but there is no effect on the conductivity.

Next, the reasons for limitation of the numerical values of the present invention will be discussed.

First, the surface roughness of plated steel sheet shown by a usual stylus-type roughness meter is, in terms of the arithmetic average roughness Ra defined by JIS B 0601, 0.3 μm to 2.0 μm. If Ra is smaller than 0.3 μm, the surface coverage of the thin-film primary rust preventive coating layer becomes good. This is desirable from the viewpoint of the corrosion resistance, but is not preferable from the viewpoint of the conductivity. As a result, setting the thickness of the thin-film primary rust preventive coating layer for achieving both conductivity and corrosion resistance becomes difficult. On the other hand, if Ra exceeds 2.0 μm, the coverage of the thin-film primary rust preventive film becomes extremely poor, and the conductivity becomes extremely good, but the corrosion resistance deteriorates. Thus, it no longer becomes possible to set a range of film thickness where both are achieved. Therefore, Ra was determined to be 0.3 μm to 2.0 μm. Preferably, Ra is 0.6 to 1.5 μm, more preferably 0.6 to 1.1 μm, most preferably about 0.9 μm. The maximum peak height Rp, for reasons similar to Ra, was also determined to be 4.0 μm to 20.0 μm. Preferably, Rp is 12 to 20 μm, more preferably 12 to 17 μm, most preferably about 15 μm.

If the zinc or zinc alloy plated steel sheet has a plating deposition smaller than 5 $g/m^2$, the sacrificial corrosion resistance action with respect to the steel sheet becomes insufficient and red rust ends up occurring in a short time, so this is not preferable. At 300 $g/m^2$ or more, the effect of improvement of the corrosion resistance ends up becoming saturated, the plating cost increases, and powdering-like plating peeling occurs, so this is not preferable.

To define the forms of the plating microcrystals of the sheet stock projecting parts, the inventors took note of the peaks of 80% or more of the Rp and defined the Ra in the range of 20 μm of the evaluation length of those parts. At parts of less than 80% of the Rp, no contact occurs with the metal rolls. Further, if smaller than the evaluation length of 20 μm, the measurement error no longer can be ignored, while if larger than 20 μm, the evaluation length can go beyond the boundary of the sheet stock projecting part and end up including depressed parts, so this is not preferred.

For the parts other than the projecting parts, the parts 20% above and below the vicinity of the average line were used for representative values. The value of the Ra (average) of those parts was made the standard value. The inventors learned that if the Ra (peak) of the sheet stock projecting parts (peak parts) is a value of 70% or more of that value, there is either no crushing by the metal rolls or only slight crushing and there is no effect on the conductivity and corrosion resistance. On the other hand, the inventors learned that if the value of Ra of those parts becomes less than 70%, the crushing by the metal rolls becomes remarkable. The upper limit of the ratio of Ra (peak)/Ra (average) is determined to be 110% since the larger the transfer of roughness of the rolls, the greater the drop in the continuous operating ability due to wrapping of zinc around the rolls etc. Preferably, the ratio of Ra (peak)/Ra (average) is 70 to 110%, more preferably 95 to 105%, most preferably about 100%.

If the peak parts become too small in Ra (peak), they end up being completely covered by the thin-film primary rust preventive coating layer and no surface conductivity is expressed, so the lower limit of Ra (peak) was determined to be 0.03 μm. On the other hand, if Ra (peak) becomes too large, the coverage rate of the coating film falls, and the surface conductivity is improved whereas the corrosion resistance deteriorates, so the upper limit thereof was determined to be 1.0 μm. Preferably, Ra (peak) is 0.03 to 1.0 μm, more preferably 0.03 to 0.5 μm, most preferably about 0.2 μm.

Further, the inventors learned that even if there are crushed parts at the sheet stock projecting parts (Ra less than 70%), if the area ratio of those parts is not more than 5% of the zinc-plated surface area as a whole, the material of the present invention achieving both conductivity and corrosion resistance is obtained. If the area ratio became larger than 5%, the characteristics of the crushed parts became dominant and the drop in conductivity became a value which cannot be ignored. The area ratio is more preferably 3% or less, most preferably 1% or less.

To leave the microcrystal forms of the sheet stock projecting parts, optimization of various operating conditions is required, but the most important thing is to prevent strong rolling by the metal rolls after the plating until the formation of the thin-film primary rust preventive coating layer. If the rolls are winding rolls, the rolling force is small and no crushing occurs, but in the case of pinch rolls where the steel sheet is contacted therewith by line contact, the upper limit of the rolling force must be controlled. At this time, the upper limit where the Vicker's hardness of the plating layer prevents crushing from occurring differs, but the hardness of a plating layer easily changes according to the electrolysis conditions or concentration of impurities in the bath, so it is not effective to define the rolling force of metal rolls across the board. The inventors studied in detail the upper limit allowable value of the roll rolling force and as a result discovered a relation defining the upper limit of the rolling force. That is, when the rolling force per mm length of the roll is F (N/mm$^2$) and the microvicker's hardness of the plating layer measured by JIS Z 2244 is MHv, the following relation stands:

$$F<9.8065\mathrm{MHv}\times(R^2-(R-h\times10^{-3})^2)^{0.5} \quad (1)$$

where, R is the roll radius (mm), while h is the value of Rp (μm) of plated steel sheet.

If F becomes larger than the value of the right side of formula (1), the plating layer ends up becoming crushed, so this is not preferred. If smaller than the value of the right side, the shapes of the projecting parts defined by the present invention can be maintained. In formula (1), if the standard MHv of pure zinc plating is 50, the radius of the pinch rolls is 100 mm, and the Rp of the plated steel sheet is 10 μm, the right side becomes 693. On the other hand, the rolling force of standard pinch rolls is 1000 to 3000 (N/mm$^2$) or so. Thus, under ordinary operating conditions, the rolling force ends up becoming a value larger than the right side and crushing ends up occurring. Therefore, it becomes necessary to control the rolling force so as to satisfy formula (1) discovered by the present invention.

It is important that the thin-film primary rust preventive film be set to a thickness achieving both conductivity and corrosion resistance. The smaller the Ra of JIS B 0651 of the sheet stock, the smaller the optimum film thickness. This value cannot be specified, but when Ra is 0.3 μm, at the minimum 0.2 μm is necessary. On the other hand, when Ra is 2.0 μm, at the maximum 5.0 μm is permitted. Therefore, the lower limit and upper limit film thicknesses were determined to be 0.2 μm and 5.0 μm. However, there are various optimum values due to the effects of a number of factors such as the shape of the sheet stock, the roughnesses Ra and Rp of the microcrystals of the projecting parts, the type of coating, etc.

The thin-film primary rust preventive layer may be of any type such as water-based resins such as acrylics, olefins, urethanes, styrenes, phenols, polyesters, etc. or solvent-based epoxies etc. Alternatively, it may be based on inorganic silica, water glass, metal salt (a Zr, Ti, Ce, Mo, or Mn oxide). Further, it may be based on an organic-inorganic composite silane coupling agent. The film may have added to it phosphoric acid, an inhibitor ingredient, or Co, Ni, or other metals for improving the corrosion resistance and improving the blackening resistance.

Single layer treatment of only the thin-film primary rust prevention film gives sufficient performance, but if further applying an undercoat treatment comprised of chromate-free undercoat treatment, the corrosion resistance, coating adhesion, and other aspects of the film performance are improved much more so this is preferred. As the chromate-free undercoat treatment agent, Zr oxide, Ti oxide, Si oxide, Ce oxide, a phosphate, a silane coupling agent, etc. may be selected. If the amount deposited is 0.001 g/m$^2$ or less, sufficient performance cannot be obtained, while if over 0.5 g/m$^2$, the effect becomes saturated and the adhesive strength conversely falls and other problems surface.

EXAMPLES

Next, the present invention will be explained in detail based on examples.

Electrogalvanized steel sheet was prepared under the following conditions. For the sheet stock, cold rolled steel sheet of a thickness of 0.8 mm was used. The surface roughness of this sheet stock was adjusted by changing the roll roughness of the rolling rolls used in the skin pass mill after continuous annealing. The roll roughness was given by a discharge dulling process. This sheet stock was electrogalvanized using an electrogalvanization facility. The electrogalvanization was performed in an acidic zinc sulfate bath at a current density of 50 to 100 A/dm$^2$ by a line speed of 50 to 120 m/min.

Hot dip galvanized steel sheet was prepared under the following conditions. For the sheet stock, cold rolled steel sheet of a thickness of 0.8 mm was used. This sheet stock was hot dip galvanized using a hot dip galvanization facility. The zinc bath was a Zn-0.2 wt % Al bath of a temperature of 460° C. The sheet stock reduced in a hydrogen-nitrogen reducing atmosphere down to 800° C. was cooled to a sheet temperature of 480° C., and was then dipped in the bath. Two seconds after dipping, it was taken out and wiped by nitrogen gas to control the amount of plating deposited. The line speed was 100 m/min. The surface was given roughness by an in-line temper rolling mill after plating.

The plated surface configuration was measured in accordance with JIS B 0651. The apparatus used was a Surfcom 1400A stylus-type surface roughness meter made by Tokyo Seimitsu. Further, the microscopic region roughness was measured using a field emission electron beam 3D roughness analyzer (ERA-8900FE) made by Elionix.

The rolling force of the metal rolls to the coating section after plating was changed from opening to 3000 N/mm to change the crushed state of the sheet stock projecting parts. The thin-film primary rust preventive coating was coated by a roll, coater to a film thickness of 0.1 to 6 μm and baked in a drying oven to a sheet temperature of 150° C. For the resin coating, a polyolefin resin ("Hitec S-7024" made by Toho Chemical) was added to pure water to give a resin solid concentration of 20 wt %, ammonium phosphate was dissolved to give a concentration of phosphoric acid ions of 1 g/L, then water-based silica ("Snowtex N" made by Nissan Chemical) was added in an amount of 25 g/L to obtain a primary rust preventive coating agent. On the other hand, for the inorganic resin-based coating, "CT-E300N" made by Nihon Parkerizing was used. For the inorganic coating, a primary rust preventive coating agent prepared by adding 50 wt % of fluorozirconic acid and 50 wt % of a silane coupling agent to pure water and adjusting the pH by phosphoric acid to 3.0 was used.

The corrosion resistance of the obtained test piece was judged by corroding the piece by the salt water spray test method of JIS Z 2371 for 72 hours and determining the area rate of the white rust on the surface. A white rust of 1% or less was evaluated as "A", one of 5% or less as "B", and one greater than 5% as "C". "A" and "B" were designated as "passing" and "C" as failing. The conductivity was measured by a LORESTA EP made by Mitsubishi Chemical. The contacter was an ESP type (4-probe type) with a contacter front end of a diameter of 2 mm and a distance between terminals of 5 mm. The number of times of conduction at a surface resistance of 1 mΩ or less by a contacter load of 1.5 N/contacter and a test current of 100 mA among 20 times at different positions was judged. Conduction 20 times was evaluated as "A", conduction 10 times to 19 times as "B", and nine times or less as "C". "A" and "B" were designated as "passing" and "C" as failing.

Table 1 shows the surface properties of the plating layer and the surface properties of the microscopic region plating layer, while Table 2 shows the data of the plating layer and the thin-film primary rust preventive coating layer. Examples 1 to 39 are examples of the present invention.

Table 3 summarizes the results of evaluation of the corrosion resistance after 72 hours of SST and the results of evaluation of the surface conductivity. Examples 1 to 39 are excellent in both corrosion resistance and conductivity and achieve both performances at all levels, while Comparative Examples 1 to 10 are poor in either corrosion resistance or conductivity and do not achieve both performances.

TABLE 1

| | Surface configuration of plating layer | | Surface properties of microscopic region plating layer | | |
|---|---|---|---|---|---|
| No. | Ra, μm | Rp, μm | Ra (peak)/Ra (average), % | Peak part Ra, μm | Area ratio of peak part Ra/average line part Ra of 70% or less, % |
| Ex. 1 | 0.3 | 4 | 100 | 0.2 | 0 |
| Ex. 2 | 0.6 | 12 | 95 | 0.2 | 0 |
| Ex. 3 | 1.1 | 15 | 98 | 0.2 | 0 |
| Ex. 4 | 1.5 | 17 | 95 | 0.2 | 0 |
| Ex. 5 | 2 | 20 | 105 | 0.2 | 0 |
| Ex. 6 | 0.9 | 15 | 70 | 0.2 | 0 |
| Ex. 7 | 0.9 | 15 | 110 | 0.2 | 0 |
| Ex. 8 | 0.9 | 15 | 100 | 0.2 | 5 |
| Ex. 9 | 0.9 | 15 | 100 | 0.2 | 3 |
| Ex. 10 | 0.9 | 15 | 100 | 0.2 | 1 |
| Ex. 11 | 0.9 | 15 | 100 | 0.2 | 1 |
| Ex. 12 | 0.9 | 15 | 100 | 0.2 | 1 |
| Ex. 13 | 0.9 | 15 | 100 | 0.2 | 1 |
| Ex. 14 | 0.9 | 15 | 100 | 0.2 | 1 |
| Ex. 15 | 0.9 | 15 | 100 | 0.2 | 1 |
| Ex. 16 | 0.9 | 15 | 100 | 0.03 | 1 |
| Ex. 17 | 0.9 | 15 | 100 | 0.1 | 1 |
| Ex. 18 | 0.9 | 15 | 100 | 0.5 | 1 |
| Ex. 19 | 0.9 | 15 | 100 | 1 | 1 |
| Ex. 20 | 0.9 | 15 | 100 | 0.2 | 1 |
| Ex. 21 | 0.9 | 15 | 100 | 0.2 | 1 |
| Ex. 22 | 0.9 | 15 | 100 | 0.2 | 1 |
| Ex. 23 | 0.9 | 15 | 100 | 0.2 | 1 |
| Ex. 24 | 0.9 | 15 | 100 | 0.2 | 1 |
| Ex. 25 | 0.9 | 15 | 100 | 0.2 | 1 |
| Ex. 26 | 0.9 | 15 | 100 | 0.2 | 1 |
| Ex. 27 | 0.9 | 15 | 100 | 0.2 | 1 |
| Ex. 28 | 0.9 | 15 | 100 | 0.2 | 1 |
| Ex. 29 | 0.9 | 15 | 100 | 0.2 | 1 |
| Ex. 30 | 0.9 | 15 | 100 | 0.2 | 1 |
| Ex. 31 | 0.9 | 15 | 100 | 0.2 | 1 |
| Ex. 32 | 0.3 | 4 | 100 | 0.2 | 0 |
| Ex. 33 | 1.1 | 15 | 100 | 0.2 | 0 |
| Ex. 34 | 1.5 | 17 | 100 | 0.2 | 0 |
| Ex. 35 | 2 | 20 | 100 | 0.2 | 0 |
| Ex. 36 | 0.9 | 15 | 100 | 0.2 | 1 |
| Ex. 37 | 0.9 | 15 | 100 | 0.2 | 1 |
| Ex. 38 | 0.9 | 15 | 100 | 0.2 | 1 |
| Ex. 39 | 0.9 | 15 | 100 | 0.2 | 1 |
| Comp. Ex. 1 | 0.2 | 3 | 100 | 0.2 | 0 |
| Comp. Ex. 2 | 2.2 | 22 | 105 | 0.2 | 0 |
| Comp. Ex. 3 | 0.9 | 15 | 60 | 0.2 | 0 |
| Comp. Ex. 4 | 0.9 | 15 | 70 | 0.2 | 10 |
| Comp. Ex. 5 | 0.9 | 15 | 100 | 0.2 | 1 |
| Comp. Ex. 6 | 0.9 | 15 | 100 | 0.2 | 1 |
| Comp. Ex. 7 | 0.9 | 15 | 100 | 0.2 | 1 |
| Comp. Ex. 8 | 0.9 | 15 | 100 | 0.2 | 1 |
| Comp. Ex. 9 | 0.9 | 15 | 100 | 0.02 | 1 |
| Comp. Ex. 10 | 0.9 | 15 | 100 | 1.5 | 1 |

TABLE 2

| | | | Microvicker's | Pinch rolls between plating and coater | | | Thin-film primary rust prevention covering layer | |
|---|---|---|---|---|---|---|---|---|
| No. | Plating type alloy system | Plating deposition, g/m$^{sup2}$ | hardness of plating layer HHV | Roll radius, mm | Rolling force, N/mm | Relation (1) stands/not | Type | Average thickness, μm |
| Ex. 1 | Electrogalvanization | 20 | 50 | 100 | 693 | Stands | Polyolefin-based | 0.7 |
| Ex. 2 | Electrogalvanization | 20 | 50 | 100 | 600 | Stands | Polyolefin-based | 0.9 |

TABLE 2-continued

| No. | Plating type alloy system | Plating deposition, g/m$^2$ | Microvicker's hardness of plating layer HHV | Pinch rolls between plating and coater: Roll radius, mm | Rolling force, N/mm | Relation (1) stands/not | Thin-film primary rust prevention covering layer: Type | Average thickness, μm |
|---|---|---|---|---|---|---|---|---|
| Ex. 3 | Electrogalvanization | 20 | 50 | 100 | 600 | Stands | Polyolefin-based | 1.1 |
| Ex. 4 | Electrogalvanization | 20 | 50 | 100 | 600 | Stands | Polyolefin-based | 1.5 |
| Ex. 5 | Electrogalvanization | 20 | 50 | 100 | 600 | Stands | Polyolefin-based | 2 |
| Ex. 6 | Electrogalvanization | 20 | 50 | 100 | 600 | Stands | Polyolefin-based | 1.2 |
| Ex. 7 | Electrogalvanization | 20 | 50 | 100 | 600 | Stands | Polyolefin-based | 1.2 |
| Ex. 8 | Electrogalvanization | 20 | 50 | 100 | 600 | Stands | Polyolefin-based | 1.2 |
| Ex. 9 | Electrogalvanization | 20 | 50 | 100 | 600 | Stands | Polyolefin-based | 1.2 |
| Ex. 10 | Electrogalvanization | 20 | 50 | 100 | 600 | Stands | Polyolefin-based | 1.2 |
| Ex. 11 | Electrogalvanization | 5 | 50 | 100 | 600 | Stands | Polyolefin-based | 1.2 |
| Ex. 12 | Electrogalvanization | 10 | 50 | 100 | 600 | Stands | Polyolefin-based | 1.2 |
| Ex. 13 | Electrogalvanization | 40 | 50 | 100 | 600 | Stands | Polyolefin-based | 1.2 |
| Ex. 14 | Electrogalvanization | 60 | 50 | 100 | 600 | Stands | Polyolefin-based | 1.2 |
| Ex. 15 | Electrogalvanization | 200 | 50 | 100 | 600 | Stands | Polyolefin-based | 1.2 |
| Ex. 16 | Electrogalvanization | 20 | 50 | 100 | 600 | Stands | Polyolefin-based | 1.2 |
| Ex. 17 | Electrogalvanization | 20 | 50 | 100 | 600 | Stands | Polyolefin-based | 1.2 |
| Ex. 18 | Electrogalvanization | 20 | 50 | 100 | 600 | Stands | Polyolefin-based | 1.2 |
| Ex. 19 | Electrogalvanization | 20 | 50 | 100 | 600 | Stands | Polyolefin-based | 1.2 |
| Ex. 20 | Electrogalv.-11 wt % Ni | 20 | 300 | 100 | 1500 | Stands | Polyolefin-based | 1.2 |
| Ex. 21 | Electrogalv.-10 wt % Cr | 20 | 200 | 100 | 100 | Stands | Polyolefin-based | 1.2 |
| Ex. 22 | Electrogalv.-1 wt % Co | 20 | 50 | 100 | 600 | Stands | Polyolefin-based | 1.2 |
| Ex. 23 | Electrogalv.-1 wt % Ni | 20 | 50 | 100 | 600 | Stands | Polyolefin-based | 1.2 |
| Ex. 24 | Electrogalv.-3 wt % Ni-7 wt % Cr | 20 | 300 | 100 | 1600 | Stands | Polyolefin-based | 1.2 |
| Ex. 25 | Electrogalv.-10 wt % Mn | 20 | 300 | 100 | 1500 | Stands | Polyolefin-based | 1.2 |
| Ex. 26 | Hot dip galv.-0.3 wt % Al | 100 | 100 | 100 | 1000 | Stands | Polyolefin-based | 1.2 |
| Ex. 27 | Hot dip galv.-5 wt % Al | 100 | 100 | 100 | 1000 | Stands | Polyolefin-based | 1.2 |
| Ex. 28 | Hot dip galv.-7 wt % Al-2.7 wt% Mg-0.1 wt % Si | 100 | 150 | 100 | 1000 | Stands | Polyolefin-based | 1.2 |
| Ex. 29 | Hot dip galv.-11 wt % Al-3 wt % Mg-0.2 wt % Si | 100 | 150 | 100 | 900 | Stands | Polyolefin-based | 1.2 |
| Ex. 30 | Zn-55 wt % Al | 100 | 60 | 100 | 600 | Stands | Polyolefin-based | 1.2 |
| Ex. 31 | Zn-55 wt % Al-0.5% Cr-2 wt % Mg | 100 | 150 | 100 | 1000 | Stands | Polyolefin-based | 1.2 |
| Ex. 32 | Electrogalvanization | 20 | 50 | 100 | 500 | Stands | Polyolefin-based | 0.2 |
| Ex. 33 | Electrogalvanization | 20 | 50 | 100 | 500 | Stands | Polyolefin-based | 2 |
| Ex. 34 | Electrogalvanization | 20 | 50 | 100 | 500 | Stands | Polyolefin-based | 3 |
| Ex. 35 | Electrogalvanization | 20 | 50 | 100 | 500 | Stands | Polyolefin-based | 5 |
| Ex. 36 | Electrogalvanization | 20 | 50 | 100 | 500 | Stands | Inorganic resin-based CT-E300N | 0.7 |
| Ex. 37 | Electrogalvanization | 20 | 50 | 100 | 500 | Stands | Inorganic based Zr-silane coupling agent | 0.5 |
| Ex. 38 | Electrogalvanization | 20 | 50 | 100 | 500 | Stands | Polyolefin-based | 1.2 |
| Ex. 39 | Electrogalvanization | 20 | 50 | 100 | 500 | Stands | Polyolefin-based | 1.2 |
| Comp. Ex. 1 | Electrogalvanization | 20 | 50 | 100 | 500 | Stands | Polyolefin-based | 0.7 |
| Comp. Ex.. 2 | Electrogalvanization | 20 | 50 | 100 | 500 | Stands | Polyolefin-based | 2 |
| Comp. Ex. 3 | Electrogalvanization | 20 | 50 | 100 | 800 | Not stand | Polyolefin-based | 1.2 |
| Comp. Ex. 4 | Electrogalvanization | 20 | 50 | 100 | 3000 | Not stand | Polyolefin-based | 1.2 |
| Comp. Ex. 5 | Electrogalvanization | 4 | 50 | 100 | 500 | Stands | Polyolefin-based | 1.2 |
| Comp. Ex. 6 | Electrogalvanization | 110 | 50 | 100 | 500 | Stands | Polyolefin-based | 1.2 |
| Comp. Ex. 7 | Electrogalvanization | 20 | 50 | 100 | 500 | Stands | Polyolefin-based | 0.1 |
| Comp. Ex. 8 | Electrogalvanization | 20 | 50 | 100 | 500 | Stands | Polyolefin-based | 6 |
| Comp. Ex. 9 | Electrogalvanization | 20 | 50 | 100 | 500 | Stands | Polyolefin-based | 3 |
| Comp. Ex. 10 | Electrogalvanization | 20 | 50 | 100 | 500 | Stands | Polyolefin-based | 6 |

TABLE 3

| No. | Corrosion resistance | Conductivity | Remarks |
|---|---|---|---|
| Ex. 1 | A | A | |
| Ex. 2 | A | A | |
| Ex. 3 | A | A | |
| Ex. 4 | A | A | |
| Ex. 5 | A | A | |
| Ex. 6 | A | A | |
| Ex. 7 | A | A | |
| Ex. 8 | A | A | |
| Ex. 9 | A | A | |

TABLE 3-continued

| No. | Corrosion resistance | Conductivity | Remarks |
|---|---|---|---|
| Ex. 10 | A | A | |
| Ex. 11 | A | A | |
| Ex. 12 | A | A | |
| Ex. 13 | A | A | |
| Ex. 14 | A | A | |
| Ex. 15 | A | A | |
| Ex. 16 | A | B | |
| Ex. 17 | A | A | |
| Ex. 18 | A | A | |

TABLE 3-continued

| No. | Corrosion resistance | Conductivity | Remarks |
|---|---|---|---|
| Ex. 19 | B | A | |
| Ex. 20 | A | A | |
| Ex. 21 | A | A | |
| Ex. 22 | A | A | |
| Ex. 23 | A | A | |
| Ex. 24 | A | A | |
| Ex. 25 | A | A | |
| Ex. 26 | A | A | |
| Ex. 27 | A | A | |
| Ex. 28 | A | A | |
| Ex. 29 | A | A | |
| Ex. 30 | A | A | |
| Ex. 31 | A | A | |
| Ex. 32 | A | A | |
| Ex. 33 | A | A | |
| Ex. 34 | A | A | |
| Ex. 35 | A | A | |
| Ex. 36 | A | A | |
| Ex. 37 | A | A | |
| Ex. 38 | A | A | |
| Ex. 39 | A | A | |
| Comp. Ex. 1 | A | C | |
| Comp. Ex. 2 | C | A | |
| Comp. Ex. 3 | A | C | |
| Comp. Ex. 4 | A | C | |
| Comp. Ex. 5 | C | A | |
| Comp. Ex. 6 | A | A | Powdering-like plating peeling, no good |
| Comp. Ex. 7 | C | A | |
| Comp. Ex. 8 | A | C | |
| Comp. Ex. 9 | A | C | |
| Comp. Ex. 10 | C | A | |

Industrial Applicability

The zinc or zinc alloy plated steel sheet of the present invention can be used as surface-treated steel sheet superior in conductivity and corrosion resistance. In particular, it can be used for applications where surface conductivity is required such as housings of copiers, facsimiles, and other office automation equipment or PC cases, AV equipment etc. where grounding is required.

The invention claimed is:

1. A rust preventive coated zinc or zinc alloy plated steel sheet superior in surface conductivity, comprising:

a zinc or zinc alloy plated steel sheet coated with a thin-film primary rust preventive coating layer;

the thin-film primary rust preventive coating layer having an average thickness of 0.2 μm to 5.0 μm, the zinc or zinc alloy plated steel sheet having an arithmetic average roughness of a zinc plated layer surface, Ra, of 0.3 μm to 2.0 μm, as defined by JIS B 0601, obtained using a stylus-type surface roughness meter, as defined by JIS B 0651, and a maximum peak height, Rp, of 4.0 μm to 20.0 μm, wherein the arithmetic average roughness of a zinc plated layer surface, Ra (peak), obtained by measuring a range of evaluation length of 20 μm of peak parts of 80% or more of the Rp by an electron beam 3D roughness analyzer is 70% or more of the arithmetic average roughness, Ra (average), obtained by measuring a range of evaluation length of 20 μm of parts of a height of ±20% about an average line, obtained by a stylus-type surface roughness meter, by an electron beam 3D roughness analyzer.

2. The rust preventive coated zinc or zinc alloy plated steel sheet as set forth in claim 1, wherein the area of the parts where the arithmetic average roughness Ra 5(peak) obtained by measuring a range of evaluation length of 20 μm of peak parts of 80% or more of the Rp defined by JIS B 0601, obtained by a stylus-type surface roughness meter, by an electron beam 3D roughness analyzer is less than 70% of the arithmetic average roughness Ra (average) obtained by measuring a range of evaluation length of 20 μm of parts of a height of ±20% about an average line, obtained by a stylus-type surface roughness meter, by an electron beam 3D roughness analyzer is 5% or less of the zinc-plated surface area as a whole.

3. The rust preventive coated zinc or zinc alloy plated steel sheet as set forth in claim 1 or 2, wherein the arithmetic average roughness Ra (peak) obtained by measuring a range of evaluation length of 20 μm of peak parts of 80% or more of the Rp defined by JIS B 0601, obtained by a stylus-type surface roughness meter, by an electron beam 3D roughness analyzer is 0.03 μm to 1.0 μm.

* * * * *

UNITED STATES PATENT AND TRADEMARK OFFICE

CERTIFICATE OF CORRECTION

PATENT NO. : 8,420,224 B2
APPLICATION NO. : 12/735628
DATED : April 16, 2013
INVENTOR(S) : Akira Takahashi et al.

It is certified that error appears in the above-identified patent and that said Letters Patent is hereby corrected as shown below:

In the Specification

Column 9, in Table 2, header of column 2, change "Plating deposition g/m$^{sup2}$" to --Plating deposition g/m$^2$--

Signed and Sealed this
Twenty-fourth Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,420,224 B2
APPLICATION NO. : 12/735628
DATED : April 16, 2013
INVENTOR(S) : Takahashi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 89 days.

Signed and Sealed this
First Day of September, 2015

Michelle K. Lee

Michelle K. Lee
*Director of the United States Patent and Trademark Office*